US007102094B2

(12) United States Patent
Xin

(10) Patent No.: US 7,102,094 B2
(45) Date of Patent: Sep. 5, 2006

(54) SWITCH

(75) Inventor: Li Xin, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 10/540,855

(22) PCT Filed: Feb. 25, 2003

(86) PCT No.: PCT/JP03/02050

§ 371 (c)(1),
(2), (4) Date: Jun. 27, 2005

(87) PCT Pub. No.: WO2004/077476

PCT Pub. Date: Sep. 10, 2004

(65) Prior Publication Data

US 2006/0113177 A1 Jun. 1, 2006

(51) Int. Cl.
*H01H 15/02* (2006.01)

(52) U.S. Cl. ..... 200/559; 200/16 C; 200/536; 200/276

(58) Field of Classification Search .... 200/16 R–16 D, 200/520, 530–532, 536, 561, 553, 557, 559, 200/563, 275, 276, 276.1
See application file for complete search history.

(56) References Cited

U.S. PATENT DOCUMENTS 3,860,776 A * 1/1975 Lockard ..... 200/276
3,924,089 A * 12/1975 Abernethy ..... 200/532
4,169,974 A * 10/1979 Peers-Trevarton ..... 200/276
6,525,285 B1 * 2/2003 Kudo et al. ..... 200/559
6,917,008 B1 * 7/2005 Ni ..... 200/563
6,967,294 B1 * 11/2005 Hsu et al. ..... 200/16 D
7,019,243 B1 * 3/2006 Tsuda et al. ..... 200/559

FOREIGN PATENT DOCUMENTS

| | | | |
|---|---|---|---|
| JP | 60-35435 | A | 3/1985 |
| JP | 60-35436 | A | 3/1985 |
| JP | 4-49432 | A | 4/1992 |
| JP | 7-93074 | B2 | 10/1995 |
| JP | 2003-86054 | A | 3/2003 |

* cited by examiner

*Primary Examiner*—Michael A. Friedhofer
(74) *Attorney, Agent, or Firm*—Foley & Lardner LLP

(57) ABSTRACT

The switch is comprised of a case, a first fixing terminal formed with a contact section exposed at the bottom surface of the case at one end with the other end being outside of the case, a second fixing terminal formed with a contact section exposed at a side surface of a case at one end and with the remaining end being provided outside of the case, a contact piece provided within the case, formed with a fixed contact section always in contact with the first fixing terminal at one end and a moveable contact section capable of contact with the other second fixing terminal at the other end, and with a coil spring section having resilience in a coil winding direction and compression direction at a central section, and an operation body with one end positioned within the case so as to form a pressing section capable of pressing the contact piece in a direction of compression and another end being positioned outside of the case so as to form an operation section pressed from outside.

1 Claim, 7 Drawing Sheets

SWITCH

BACKGROUND OF THE INVENTION

1. Field of the Invention

This invention relates to a push-type switch used in electronic equipment, and specifically relates to a switch turning on and off as a result of ends of a built-in coil spring connecting and disconnecting with contact terminals.

2. Description of Related Art

For example, a "switch" as disclosed in Japanese Laid-open Patent Publication No. Hei. 7-93074 (related art 1) is provided where a conductive spring is built-into a casing, so that the switch is made to go on and off as a result of contact pieces freely making and breaking contact with connection terminals provided on the inside surface of the box. The "switch" of related art 1 is comprised of a substantially box-shaped case where fixing elements are implanted in a planar manner in an inner bottom surface, a coiled spring contacting piece having a moving end having a springy conductive member curved in the shape of a U with a contact point at an end thereof curved substantially in a semi-circle shape and a fixing end having a contact point at an end thereof while being substantially straight, an operating body constituted by a substantially cylindrical molded member having an inverted c-shaped groove at one end, sliding in a longitudinal direction so as the inverted c-shaped groove traverses the moving end of the contact piece, and a cover supporting the operating body coupled to the case in a slidable manner and sandwiching the coil of the contact piece together with the case.

In related art 1, as shown in FIG. 15, fixing terminals 112 and 113 are provided at the bottom surface within the case 111. A contact piece 114 made of a conductive member having springiness is provided within the case 111. The contact piece 114 is provided such that one end of a coiled spring section 114*e* is curved in a U-shape, and is formed with a moveable end 114*b* having a contact point 114*c* bent in a substantially semi-circular shape at one end, and the other end is in a rectilinear shape forming a fixing end 114*a* having a contact point 114*d* making contact with the fixing terminal at the front end.

A contact piece 114 forming a fixing end 114*a* having a contact point 114*d* making contact with the terminal 112 is provided.

An operating body 115 is substantially cylindrical and has an inverted c-shaped groove 115*a* at one end. This groove 115*a* spans the movable end 114*c* of the contact piece 114 and is made to slide in a longitudinal direction so that the contact point 114*c* and the fixing terminal 113 connect and disconnect.

The cover 116 is a lid containing the contact piece 114 within the upper part of the case 111. The cover 116 has a hole 116*a* supporting the operating body 115 in a manner capable of sliding, links with the case 111, and has a projection 116*b* sandwiching the coil section 114*e* of the contact piece 114 together with a u-shaped depression 111*a* of the case 111.

In the related art 1 formed in this manner, the moveable end 114*b* is caused to move downwards as a result of the operating body 115 being pressed downwards so as to slide in a manner resisting spring force of the contact piece 114. At this time, the moveable end 114*b* is made to move according to the spring force of a coil spring and a curve of the moveable end 114*b* as a result of a spring section 114*e* moving in a winding direction of the coiled spring taking the contact point 114*d* making contact with the contact terminal 112. The contact point 114*c* moves in a horizontal direction in FIG. 15 as a result of the moveable end 114*b* moving in a downward direction, and is moved to the position of the fixing terminal 113 so as to make contact with the fixing terminal 113, so that the fixing terminal 112 and the fixing terminal 113 enter a conducting state.

Further, when the thrust of the operating body 115 ends, the contact piece 114 returns to its original position due to its own spring force, the contact point 114*c* is separated from the fixing terminal 113, and the fixing terminal 112 and the fixing terminal 113 enter an insulating state.

However, with the switch of related art 1, the operating body 115 is slid downwards so that the fixing end 114*a* and the moveable end 114*b* of the contact piece 114 make contact with the fixing terminal 112 and fixing terminal 113. However, the operating force acting against movement in a downward direction and the contact force necessary in contact between the contact terminal 113 and the fixed terminal 114*a* and contact between the contact terminal 113 and the moveable end 114*b* is made by the resilient force due to torsion in the winding direction of the spring section 114*e* of the contact piece 114.

Resilient force generated by torsion in the winding direction of the coil spring changes according to the amount of torsion. It is therefore difficult to maintain a set value for contact pressure between the contact piece and the fixing terminal.

In particular, with push switches for detecting position used in various electronic equipment for detecting a position of a CD tray etc. of a CD player or computer etc., the operation force used in pressing the push switch is 0 and contact pressure between the contact piece and the fixing terminal is ideally a set value. In the related art example, when the operation force pressing the push switch is made small, contact pressure between the contact piece and the fixing terminals becomes small and there is therefore the problem that the operation force has to be large to implement the set contact pressure. When operation force is made small, the contact pressure is also made small, and contact pressure at a contact start position for the contact piece and the fixing terminal and contact pressure at a time when the contact piece further moves after contact become different. Contact resistance at the contact start position therefore becomes large, errors occur at positions judged to be conducting, and detected position precision therefore becomes poor.

The operation direction of the contact piece due to the operating body deforms the contact piece in the winding direction of the coil spring. This therefore made it difficult to make the operation direction of the switch short.

In order to resolve the aforementioned problems, this invention is advantageous in providing a switch where change in contact pressure due to the position of a contact piece is small.

SUMMARY OF THE INVENTION

A switch characterized by: a case forming a case shape; a pair of fixing terminals with contact sections exposed at an inner surface of a case formed at one end and with remaining ends being positioned outside of the case; a contact piece, provided within the case, with a fixing contact section always in contact with a fixing terminal formed at one end, a moveable contact section capable of making contact with another fixing terminal provided at the other end, and a central part with a coil spring having resilience in a coil winding direction and compression direction; and an operation body with one end positioned within the case so as to form a pressing section capable of pressing the contact piece in a compression direction and with another end positioned outside of the case so as to form an operation section pressed from outside.

The contact piece provided within the case is such that a fixing contact section constituting one end is always connected to a fixed terminal and a moveable contact section constituting another end is pressed against a wall within the case due to resilient force in a winding direction of the coil spring at the inner wall of the case so as to make contact so as to be positioned in a position capable of making contact with the other fixed terminal but not in contact in a usual state.

In this state, when the operation section of the operation body is pressed down, the operation body moves in a direction to within the case. In doing so, the pressing section of the operation body presses and compresses the coil spring of the contact piece in a direction of compression.

The contact piece moves while making contact with an inside wall of the case due to the resilient force in the twisting direction of the coil spring, and makes contact with the other fixing terminal.

The switch is then put into an electrically conducting state by short-circuiting the fixed terminals as a result of the fixing contact section and the moveable contact section of the contact piece making contact with the respective fixing terminals.

When pressing of the operation part of the operation body is released, the contact piece is elongated due to resilient force in a compression direction of the coil spring and an initial position is returned to. The operation body therefore moves back to the original position as a result of resilient force in the compression direction of the coil spring.

DESCRIPTION OF THE EMBODIMENTS

Figure 1:
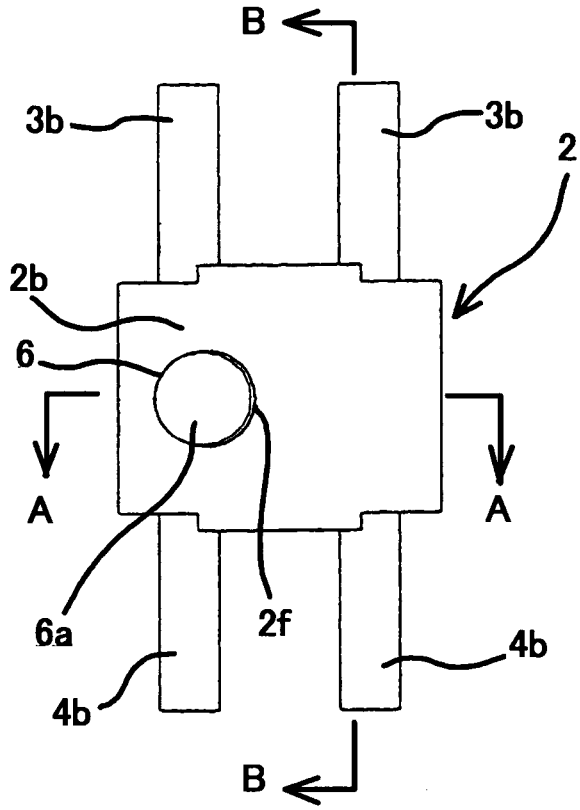
FIG. 1 is a plan view illustrating a first embodiment of the invention.
Figure 2:
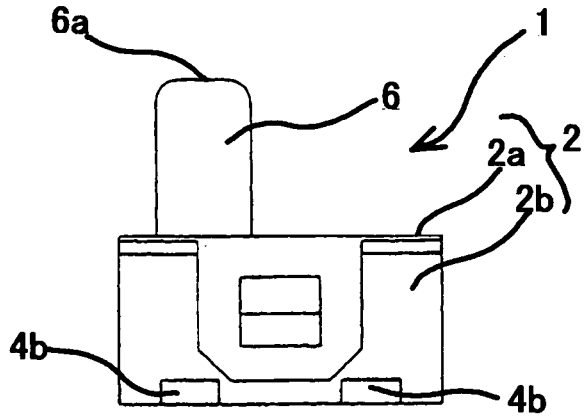
FIG. 2 is a front view illustrating the same.
Figure 3:
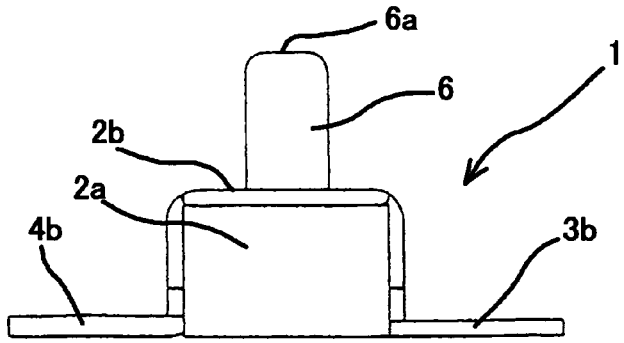
FIG. 3 is a right side view illustrating the same.
Figure 4:
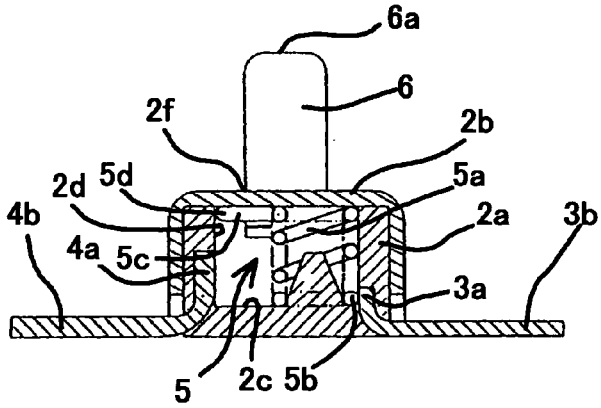
FIG. 4 is a cross-section illustration along line A—A of FIG. 1.
Figure 5:
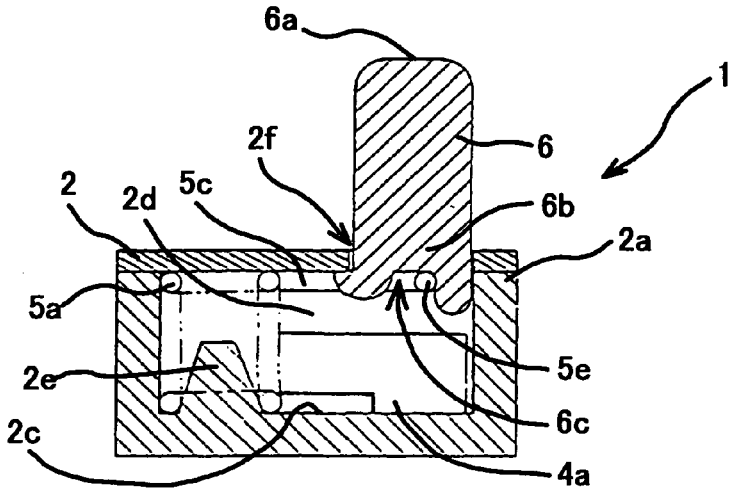
FIG. 5 is a cross-section illustration along line B—B of FIG. 1.
Figure 6:
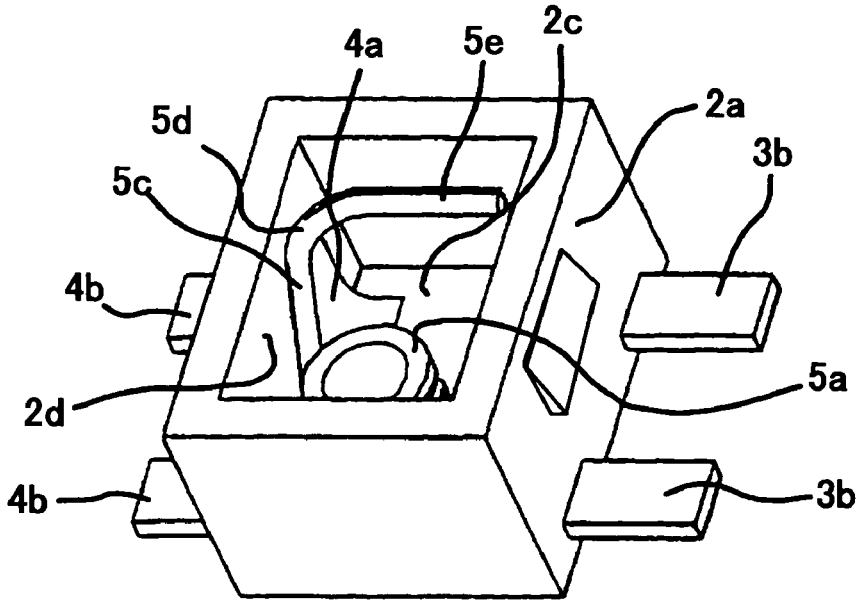
FIG. 6 is a perspective illustration showing the first embodiment with a part removed.
Figure 7:
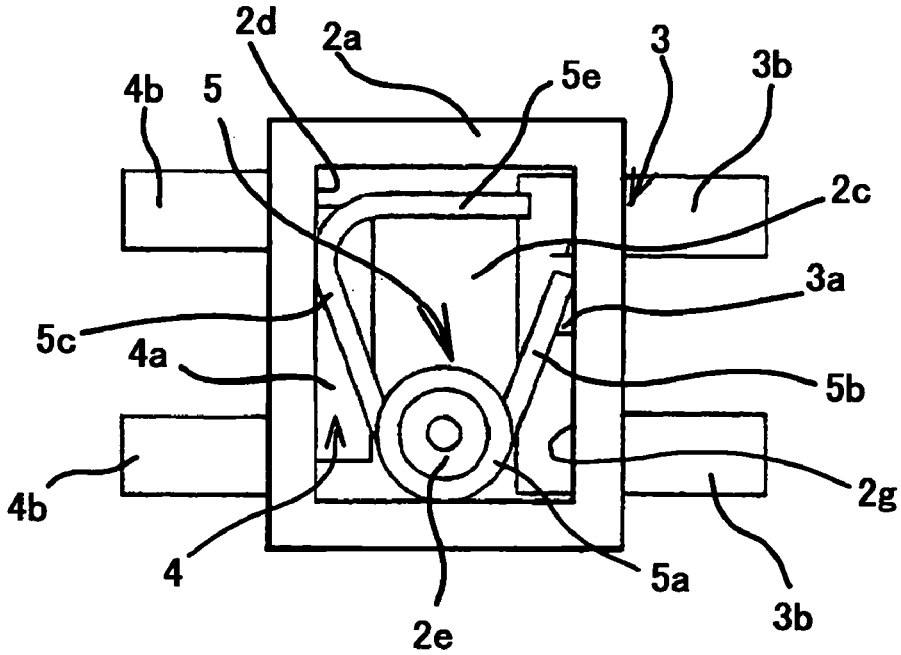
FIG. 7 is a view illustrating the same.

Numeral 1 is a switch of a first embodiment of the invention. The switch 1 is a push-switch for position detection used for various electronic equipment and may be used, for example, for detecting moveable positions of positions of CD trays used as moveable members in CD drives etc. for use in audio equipment or computers etc. As shown in FIG. 1 to FIG. 6, the switch 1 is comprised of a case 2 consisting of a case body 2*a* formed of a substantially cylindrical shape with one end open and a cover 2*b* covering the open end of the case body 2*a*, a first fixing terminal 3 provided so that a contact section 3*a* is exposed at the bottom surface 2*c* of the case 2 within the case 2, a second fixing terminal 4 provided on a side surface of the case 2 within the case 2 so that a contact point 4*a* is exposed, a contact piece 5 with a central section making contact with a side surface 2*d* within a case 2 as a result of both ends of a coil spring shape and an operation body 6 enabling the contact piece 5 to be pressed from outside of the case 2.

The case 2 is such that the case body 2*a* is formed from polyphthalimide resin, a projection 2*e* for positioning the contact piece 5 is formed facing towards the upper surface at the end of the bottom surface 2*a*, and the cover 2*b* is formed of a metal plate. An opening 2*f* is provided at the cover 2*b* so that an operation body 6 can be inserted through at a location positioned at a side of an end part of the case body 2*a* different to the upper end of the projection 2*e* while the cover 2*b* covers the opening of the case body 2*a*.

A plane-shaped contact section 3*a* is formed at one end of the first fixing terminal 3, and a connection terminal 3*b* is formed at the other end.

A plane-shaped contact point 4*a* is formed at one end of the second fixing terminal 4, and a connection terminal 4*b* is formed at the other end.

The first fixing terminal 3 and second fixing terminal 4 are formed integrally by insertion molding together with the case body 2*a* in such a manner that the connection terminal 3*b* and the connection terminal 4*b* project to outside of the case body 2*a* and the contact section 3*a* is exposed by the bottom surface 2*c* within the case body 2*a*, and the contact point 4*a* is exposed at the side surface 2*d* within the case body 2*a*.

Figure 8:
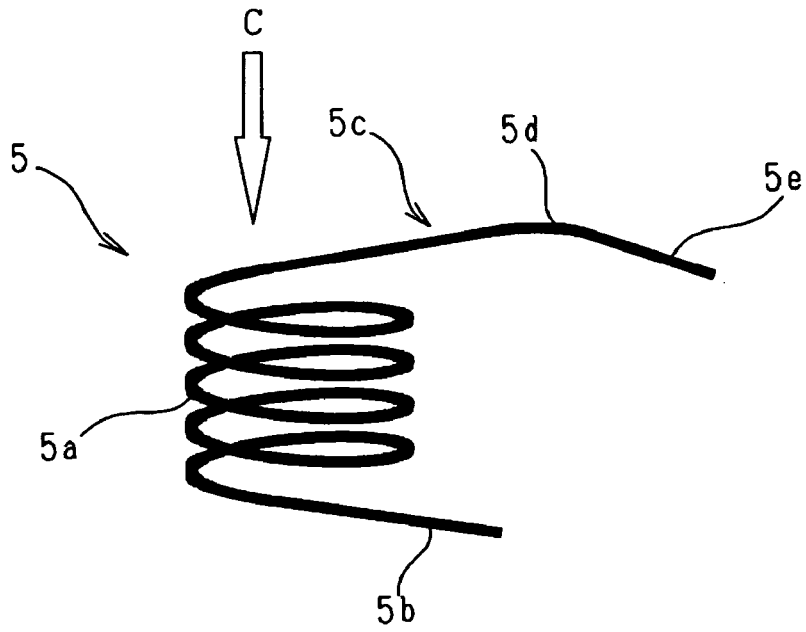
FIG. 8 is a perspective view illustrating parts of the first embodiment.
Figure 9:
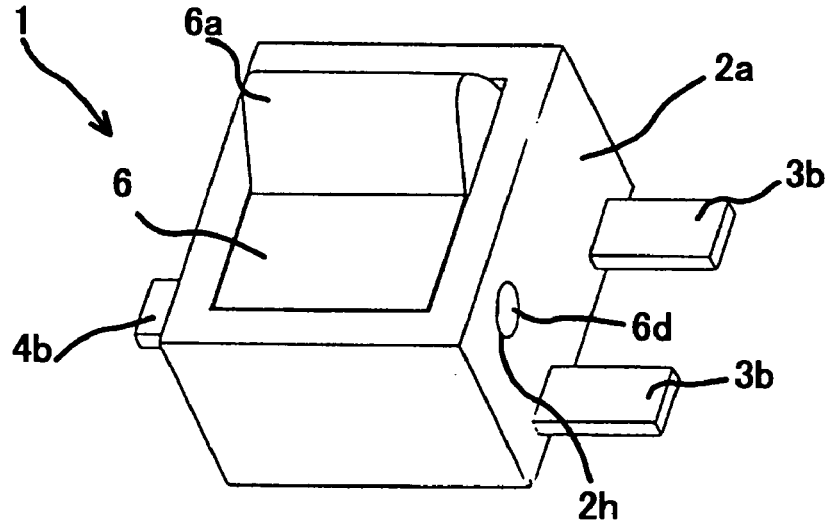
FIG. 9 is a perspective plan view illustrating a second embodiment of this invention.
Figure 10:
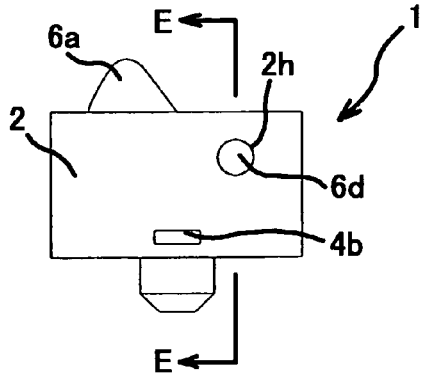
FIG. 10 is a front view illustrating the same.
Figure 11:
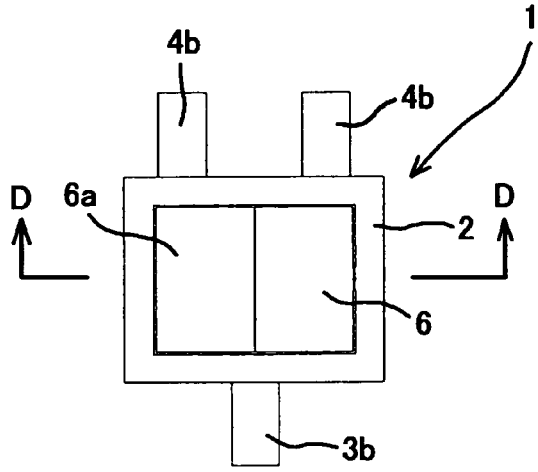
FIG. 11 is a plan view illustrating the same.
Figure 12:
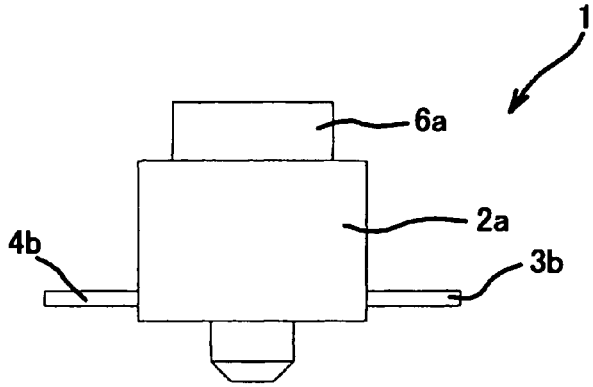
FIG. 12 is a right side view illustrating the same.
Figure 13:
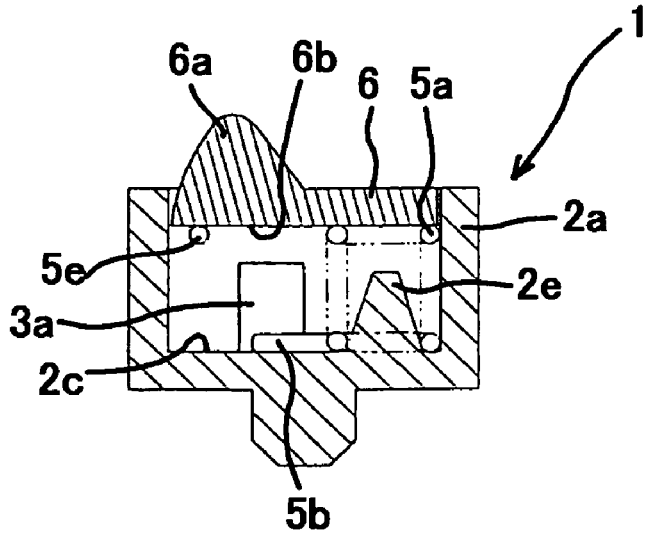
FIG. 13 is a cross-sectional illustration along line D—D of FIG. 11.
Figure 14:
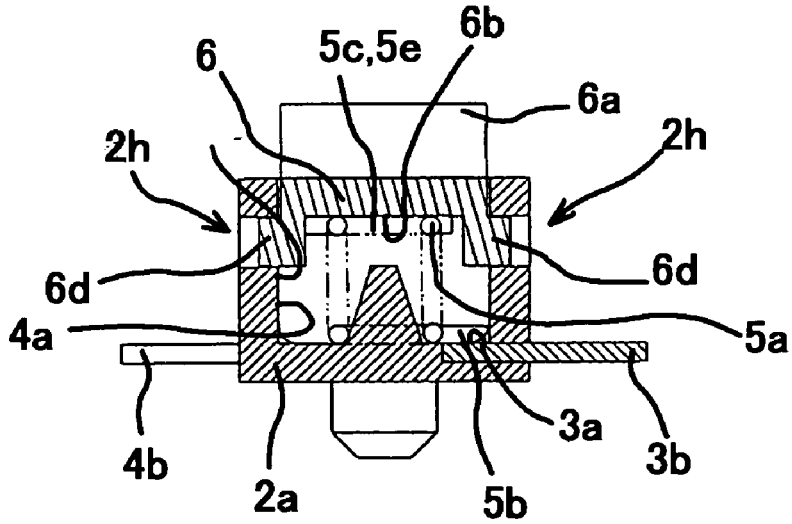
FIG. 14 is a cross-sectional illustration along line E—E of FIG. 10.
Figure 15:
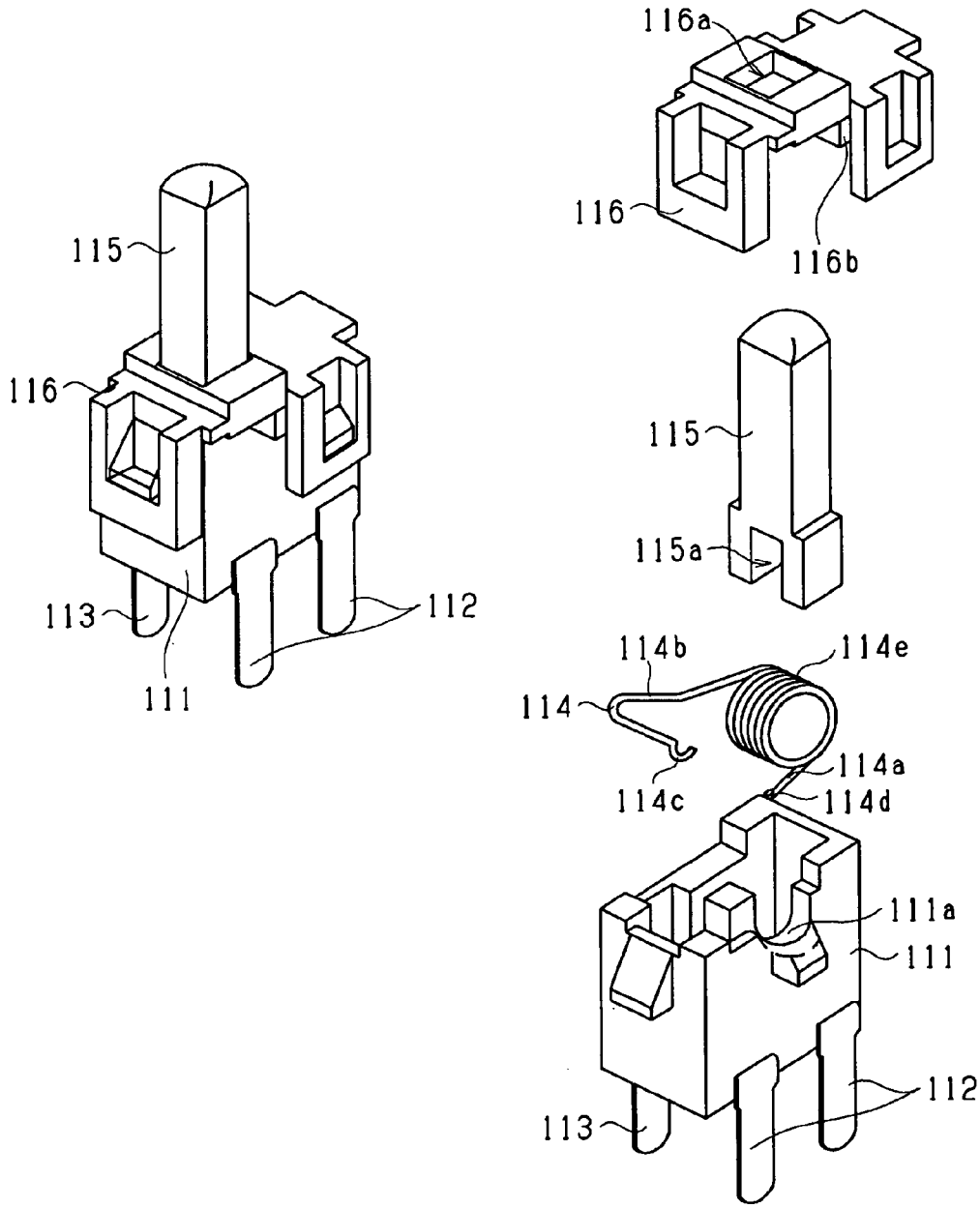
FIG. 15 is a view illustrating the related art.

A contact piece 5 is comprised of a conductive member with a coil spring section 5*a* presenting a coil spring shape being formed at a central part thereof. The coil spring section 5*a* has resilience in a direction of winding of the coil, as shown in FIG. 8, and has resilience in a direction of compression as shown by arrow C in FIG. 8. A fixed contact point 5*b* is formed at an end of the contact piece 5 extending from the coil spring section 5*a*. The fixed contact point 5*b* is provided by forming one end of the coil spring section 5*a* in a rectilinear manner. A movable contact section 5*c* is then formed at the other end of the contact piece 5. A curved section 5*d* is provided at the end of the movable contact section 5*c* so as to be curved in an L-shape, with a tip rectilinear section 5*a* being formed from the curved section 5*d*.

The operation body 6 is comprised of a cylindrical body capable of being inserted into a hole 2*f* formed at the cover 2*b* with one end positioned outside of the case 2 forming a pressing section 6*a* when inserted in the cover 2*b* and another end positioned within the case 2 forming an operation section 6*b*. The pressing section 6*a* constitutes a target of position detection, and is a member pressed by, for example, a CD tray etc. The operation section 6*b* is formed with a c-shaped groove 6*c* at its tip. The operation body 6 is provided so that the tip rectilinear section 5*e* of the movable contact section 5*c* inserts into the inverse c-shaped groove 6*c* and is inserted in the cover 2*b* so that the operation section 6*b* is positioned within the case 2.

As shown in the drawings, the contact piece 5 is inserted into the case body 2*a* in a position where the fixed contact point 5*b* on at the side of the bottom surface 2*c* positioned in such a manner that a projection 2*e* projecting from within the case 2 is inserted into a hollow of the coil spring section 5*a* so that the fixed contact point 5*b* and the movable contact section 5*c* are compressed in a winding direction of the coil spring section 5*a*. The contact piece 5 is positioned in such a manner that the fixed contact point 5*b* makes contact with the contact section 3*a* of the first fixing terminal 3 provided at the bottom surface 2*c* within the case 2 and so that the movable contact section 5*c* is positioned at the upper side of the contact point 4*a* of the second fixing terminal 4 provided at the side surface 2*d* within the case 2. Further, the tip rectilinear section 5*e* of the movable contact section 5*c* is inserted into the inverse c-shaped groove 6*c* with the operation body 6 inserted through a hole 2*f* of the cover 2*b*. In this state, the cover 2*b* is fixed in such a manner that the open side of the case body 2*a* is closed over. Because the cover 2*b* is fitted to the case body 2*a*, the fixed contact point 5*b* is compressed in a direction of compression C between the operation body 6 and the bottom surface 2*c* and a contact state is therefore maintained due to the resilience of the coil spring section 5*a* in the direction of compression C. The movable contact section 5*c* is also provided positioned at the upper side of the contact point 4*a* provided at the side surface 2*d* so as to be pressed in a state of contact with the side surface 2*d* by the resilient force of the winding direction of the coil spring section 5*a*.

The following is a description of the operation of a first embodiment.

The switch 1 presses against a pressing section 6*a* of the operation body 6 in a state fitted at a prescribed position of the circuit substrate etc.

In doing so, the operation body 6 slides within the hole 2*f* of the cover 2*b*. When the operation body 6 slides, the tip rectilinear section 5*e* of the movable contact section 5*c* is inserted into the groove 6*c* of the operation body 6. The coil spring section 5*a* of the contact piece 5 therefore moves in a direction so as to be compressed in the direction of arrow C and the point of operation to the contact piece 5 becomes the tip rectilinear section 5*e* away from the coil spring section 5*a*. The coil spring section 5*a* therefore buckles. The curved section 5*d* of the movable contact section 5*c* moves while making contact with the side surface 2*d* within the case body 2*a*, makes contact with the contact point 4*a* of the second fixing terminal 4, and a state is attained where the contact piece 5 puts the first fixing terminal 3 and the second fixing terminal 4 in an electrically conducting state. At this time, the contact pressure between the contact point 4*a* of the fixing terminal 4 and the curved section 5*d* of the movable contact section 5*c* depends on the resilient force of the winding direction of the coil spring section 5*a*. Change in the contact pressure due to movement resulting from pressing of the operation body 6 therefore becomes substantially zero.

When pressing of the pressing section 6*a* is released, the operation body 6 returns to the original position due to the resilient force of the spring section 5*a* in the direction of arrow C and the curved section 5*d* of the movable contact section 5*c* also moves in an upward direction as shown in the drawings so that contact with the contact point 4*a* of the second fixing terminal 4 is also released.

The switch 1 of the first embodiment is such that the operation direction is the winding direction of the coil spring section 5*a*. However, in the following, a description is given based on FIG. 9 to FIG. 14 of a second embodiment of a switch 1 capable of operation at right-angles to the direction of winding of the coil spring section 5*a*.

With the switch 1 of the second embodiment, a cover 2*b* is not provided but rather the operation body 6 doubles as the cover 2*b*.

The operation body 6 is comprised of a plate-shaped body substantially the same shape as the opening of the case body 2*a* and forms the pressing section 6*a* constituting a mountain-shaped projection having a gradual incline at the upper surface end of the operation body 6. A central projection 6*d* projects centered about a center of swing where swinging of the pressing section 6*a* is possible at both sides on the opposite side to the pressing section 6*a* of the operation body 6. The coil spring section 5*a* and the movable contact section 5*c* come into contact at the time of fitting of the case body 2*a* at the surface opposite to the pressing section 6*a* of the operation body 6, with this opposing surface forming the operation section 6*b*.

Further, the case body 2*a* latching the operation body 6 is formed in a substantially boxed shape with one end open, as with the first embodiment. Similarly, as with the first embodiment, the first fixing terminal 3 is also formed provided with a contact section 3*a* and a connection terminal 3*b* and the second fixing terminal 4 is also formed provided with a contact section 4*a* and connection terminal 4*b*. As with the first embodiment, the first fixing terminal 3 and second fixing terminal 4 are formed integrally by insertion molding together with the case body 2*a* in such a manner that the connection terminal 3*b* and the connection terminal 4*b* project to outside of the case body 2*a* and the contact section 3*a* is exposed by the bottom surface 2*c* within the case body 2*a*, and the contact point 4*a* is exposed at the side surface 2*d* within the case body 2*a*.

As with the first embodiment, the case body 2*a* is integrally molded as with the first embodiment, but a point of difference with the first embodiment is that fitting holes 2*h* through which it is possible to insert central projections 6*d* of the operation body 6 are formed at the upper part of both side surfaces 2*d*, 2*g* on the sides where the projection 2*e* projects at the bottom surface 2C. Other than the providing of the fitting holes 2*h*, the case body 2*a* is the same as for the first embodiment.

Further, as with the first embodiment, the contact point 4*a* is also formed provided with the coil spring section 5*a*, fixed contact point 5*b*, movable contact section 5*c*, curved section 5*d*, and tip rectilinear section 5*e*.

The switch 1 of the second embodiment is such that the central projection 6*d* of the operation body 6 is inserted into the fitting hole 2*h* of the case body 2*a* with the contact piece 5 provided within the case body 2*a* as with the first embodiment, and the operation body 6 is fitted to the case body 2*a* in a freely swinging manner. In this state, the contact piece 5 is in a stable state where there is no compression in the direction of the arrow C is provided in such a manner as to be in a state of being deformed in the direction of winding of the coil spring section 5*a* in the case body 2*a*. The curved section 5*d* provided at the movable contact section 5*c* of the contact piece 5 is in a state of being pressed at the side surface 2*d* of the case body 2*a*. The operation body 6 is mounted on the coil spring section 5*a* and movable contact section 5*c* of the contact piece 5 so that the pressing section 6*a* projects at the upper part of the case body 2*a*.

When the pressing section 6*a* of the operation body 6 is pressed, the switch 1 of the second embodiment formed in this manner is such that the operation body 6 swings to the side of the bottom surface 2*c* of the case body 2*a* centered around the central projection 6*d*. In doing so, as in the first embodiment, when the movable contact section 5*c* of the contact piece 5 is moved to the side of the bottom surface 2*c* along the side surface 2*d* within the case body 2*a*, the coil spring section 5*a* is compressed to the side of the bottom surface 2*c* while being slightly buckled. The curved section 5*d* of the movable contact section 5*c* makes contact with the contact point 4*a* of the second fixing terminal 4 provided at the side surface 2*d* of the case body 2*a*, and the contact piece 5 puts the first fixing terminal 3 and the second fixing terminal 4 into an electrically conducting state.

When pressing of the pressing section 6*a* is released, the operation body 6 returns to the original position due to the resilient force of the spring section 5*a* in the direction of arrow C and the curved section 5*d* of the movable contact section 5*c* also moves in an upward direction as shown in the drawings so that contact with the contact point 4*a* of the second fixing terminal 4 is also released.

In the second embodiment, the operation body 6 is provided in a freely swinging manner so that the operation section 6*b* compresses and moves the coil spring section 5*a* and the movable contact section 5*c*. The operation of the switch 1 may therefore be a pressing force in the direction of the bottom surface 2*c* from the top of the switch 1, i.e. pressing force in the compression direction of the coil spring section 5*a* or may be pressing force in a direction parallel with the upper surface of the switch 1, i.e. in a direction pressing the inclined surface side of the pressing section 6*a* of the operation body 6. In the case of operation by the pressing force in a parallel direction at the upper surface of the switch 1, part of the pressing force pressing the inclined surface of the pressing section 6*a* is converted to swinging force as a result of causing the operation body 6 to swing at the side of the bottom surface 2*c* and becomes pressing force compressing the coil spring section 5*a* in the pressing direction.

In the second embodiment, the operation body 6 is fitted without compressing the contact piece 5 in the direction of the bottom surface 2*c* of the case body 2*a*. However, during fitting of the operation body 6 to the case body 2*a*, it is also possible to provide a latching recess and latching protrusion restricting swinging towards the upper part of the case body 2*a* on the side of the operation section 6*b* at the upper part of the side of the operation body 6 on the side of the operation section 6*b* and the case body 2*a* so that the operation body 6 is fitted to the case body 2*a* in a state where the coil spring section 5*a* of the contact piece 5 is compressed in the direction of the bottom surface 2*c*.

According to the present invention, as a result of forming the switch in the manner described above, there is substantially no deformation in the direction of winding of the coil spring section at the time of operation and the contact pressure when the contact piece makes contact with the fixed terminals is substantially fixed regardless of the extent of change in the movement of the operation body. As a result, the occurrence of a difference in a contact pressure at a contact start position where a contact piece puts a fixed terminal into a conducting state and a contact pressure for a time where the contact piece is further moved after contact that in turn causes errors in a position determining a conducting state does not occur, and precision of position detection can be improved.

Further, operation is possible without the contact piece being changed in the radial direction of the coil. The contact piece can therefore be installed in such a manner that the radial direction of the coil for the coil spring section and the switching operation direction of the connection piece are different, so that the length of the switching operation direction can be made small.

What is claimed is:

1. A switch characterized by:

a case forming a case shape;

a pair of fixing terminals with contact sections exposed at an inner surface of a case formed at one end and with remaining ends being positioned outside of the case;

a contact piece, provided within the case, with a fixed contact section always in contact with the one of the fixing terminals formed at one end, and a moveable contact section capable of making contact with the other of the fixing terminals provided at the other end, and a central part with a coil spring having resilience in a winding direction of a coil and compression direction; and an operation body with one end positioned within the case so as to form a pressing section capable of pressing the contact piece in a compression direction and an operation section with another end positioned outside of the case so as to form an operation section pressed from outside.

* * * * *